US010418734B1

(12) United States Patent
Henry et al.

(10) Patent No.: US 10,418,734 B1
(45) Date of Patent: Sep. 17, 2019

(54) CONTACT ASSEMBLY FOR A STRADDLE MOUNT CONNECTOR

(71) Applicants: TE CONNECTIVITY CORPORATION, Berwyn, PA (US); TYCO ELECTRONICS JAPAN G.K., Kawasaki-shi (JP)

(72) Inventors: Randall Robert Henry, Lebanon, PA (US); Katsuhiko Kobayashi, Kawasaki (JP); Michael John Phillips, Camp Hill, PA (US)

(73) Assignees: TE CONNECTIVITY CORPORATION, Berwyn, PA (US); TYCO ELECTRONICS JAPAN G.K., Kawasaki-Shi (JP)

( * ) Notice: Subject to any disclaimer, the term of this patent is extended or adjusted under 35 U.S.C. 154(b) by 0 days.

(21) Appl. No.: 16/045,925

(22) Filed: Jul. 26, 2018

(51) Int. Cl.

| | |
|---|---|
| ***H01R 13/436*** | (2006.01) |
| ***H01R 12/73*** | (2011.01) |
| ***H01R 13/6473*** | (2011.01) |
| ***H01R 13/424*** | (2006.01) |
| ***H01R 12/72*** | (2011.01) |
| *H01R 13/514* | (2006.01) |

(52) U.S. Cl.
CPC ..... *H01R 12/732* (2013.01); *H01R 12/721* (2013.01); *H01R 13/424* (2013.01); *H01R 13/6473* (2013.01); *H01R 13/436* (2013.01); *H01R 13/514* (2013.01)

(58) Field of Classification Search
None
See application file for complete search history.

(56) References Cited

U.S. PATENT DOCUMENTS

| | | | | |
|---|---|---|---|---|
| 4,039,241 A | | 8/1977 | Perry et al. | |
| 5,288,251 A | * | 2/1994 | Sumida | H01R 13/514 439/701 |
| 5,573,430 A | * | 11/1996 | Hatagishi | H01R 13/506 439/400 |
| 5,957,732 A | * | 9/1999 | Ito | H01R 13/506 439/701 |
| 6,007,386 A | * | 12/1999 | Okabe | H01R 13/42 439/701 |
| 7,004,767 B2 | | 2/2006 | Kim | |

(Continued)

FOREIGN PATENT DOCUMENTS

| | | |
|---|---|---|
| CA | 1053341 A | 4/1979 |
| EP | 2731199 A1 | 5/2014 |

(Continued)

OTHER PUBLICATIONS

U.S. Appl. No. 16/210,733, filed Dec. 5, 2018.

*Primary Examiner* — Tho D Ta

(57) ABSTRACT

A straddle mount connector includes a housing and a contact assembly received in a cavity of the housing between a mating card slot and a host board slot. The contact assembly has a contact organizer having upper and lower contact channels in a top wall and a bottom wall, respectively receiving upper and lower contacts and engaging corresponding upper and lower locating features. The upper and lower contacts are electrically connected to a host board and a mating card. The contact assembly is loaded into the cavity such that upper and lower blocking surfaces of the housing block the upper contacts in the upper and lower contact channels.

20 Claims, 5 Drawing Sheets

(56) References Cited

U.S. PATENT DOCUMENTS

| | | | | |
|---|---|---|---|---|
| 7,114,963 | B2 | 10/2006 | Shuey et al. | |
| 2007/0243770 | A1* | 10/2007 | Hsieh | H01R 13/4361 439/701 |

FOREIGN PATENT DOCUMENTS

| | | | |
|---|---|---|---|
| JP | 2005-19305 | A | 1/2005 |
| JP | 2016-219101 | A | 12/2016 |

* cited by examiner

CONTACT ASSEMBLY FOR A STRADDLE MOUNT CONNECTOR

BACKGROUND OF THE INVENTION

The subject matter herein relates generally to a contact assembly for a straddle mount connector.

Straddle mount connectors are used to provide a connector interface at an edge of a circuit board. The straddle mount connector includes a housing holding contacts terminated to the circuit board. Some known straddle mount connectors utilize a housing that holds a separate contact assembly therein. The contact assembly is formed from two separately manufactured contact arrays. The contact arrays are overmolded leadframes that are assembled together and separately loaded into the housing. However, such contact assemblies are not without disadvantages. For instance, each change in the straddle mount connector requires a retooling in the contact assembly, such as retooling of the contacts and the overmolding dies, which requires a large capital expenditure.

A need remains for a straddle mount connector that may be manufactured in a cost effective and reliable manner.

BRIEF DESCRIPTION OF THE INVENTION

In one embodiment, a straddle mount connector is provided including a housing and a contact assembly received in a cavity of the housing. The housing extends between a front and a rear. The housing has a mating card slot at the front configured to receive a mating card and a host board slot at the rear configured to receive a host board. The housing has a cavity between the mating card slot and the host board slot defined by an upper wall and a lower wall. The upper wall has upper blocking surfaces and the lower wall has lower blocking surfaces. The contact assembly has a contact organizer including a body having a top wall and a bottom wall. The contact organizer has upper contact channels in the top wall and lower contact channels in the bottom wall. The upper contact channels have upper locating features and the lower contact channels have lower locating features. The contact assembly has upper contacts arranged in an upper contact array and lower contacts arranged in a lower contact array. The upper contacts are received in corresponding upper contact channels and engage corresponding upper locating features. The lower contacts are received in corresponding lower contact channels and engage corresponding lower locating features. The upper contacts and the lower contacts are configured to be electrically connected to the host board and the mating card. The contact assembly is loaded into the cavity such that the upper blocking surfaces block the upper contacts in the upper contact channels and such that the lower blocking surfaces block the lower contacts in the lower contact channels.

In another embodiment, a straddle mount connector is provided including a housing and a contact assembly received in the cavity of the housing. The housing extends between a front and a rear. The housing has a mating card slot at the front configured to receive a mating card and a host board slot at the rear configured to receive a host board. The housing has a cavity between the mating card slot and the host board slot defined by an upper wall and a lower wall. The upper wall has upper ribs extending therefrom having upper blocking surfaces and the lower wall has lower ribs extending therefrom having lower blocking surfaces. The contact assembly has a contact organizer including a body having a top wall and a bottom wall. The contact organizer has upper contact channels in the top wall and lower contact channels in the bottom wall. The upper contact channels have upper locating features and the lower contact channels have lower locating features. The contact assembly has upper contacts arranged in an upper contact array and lower contacts arranged in a lower contact array. The upper contacts are received in corresponding upper contact channels and engage corresponding upper locating features. The lower contacts are received in corresponding lower contact channels and engage corresponding lower locating features. The upper contacts and the lower contacts are configured to be electrically connected to the host board and the mating card. The contact assembly is loaded into the cavity such that the upper ribs are received in the upper contact channels with the upper blocking surfaces engaging the upper contacts and such that the lower ribs are received in the lower contact channels with the lower blocking surfaces engaging the lower contacts.

In a further embodiment, a straddle mount connector is provided including a housing and a contact assembly received in the cavity of the housing. The housing extends between a front and a rear. The housing has a mating card slot at the front configured to receive a mating card and a host board slot at the rear configured to receive a host board. The housing has a cavity between the mating card slot and the host board slot defined by an upper wall and a lower wall. The upper wall has upper blocking surfaces and the lower wall having lower blocking surfaces. The contact assembly has a contact organizer including a body having a top wall and a bottom wall. The contact organizer has upper contact channels in the top wall and lower contact channels in the bottom wall. The upper contact channels have upper locating features and the lower contact channels have lower locating features. The contact assembly has upper contacts arranged in an upper contact array and lower contacts arranged in a lower contact array. The upper contacts are received in corresponding upper contact channels and engage corresponding upper locating features and the lower contacts are received in corresponding lower contact channels and engage corresponding lower locating features. The upper contacts have first mating ends extending forward of the body and second mating ends extending rearward of the body. The lower contacts have first mating ends extending forward of the body and second mating ends extending rearward of the body. The contact assembly is loaded into the cavity such that the first mating ends of the upper contacts and the first mating ends of the lower contacts extend into the mating card slot for mating with the mating card and such that the second mating ends of the upper contacts and the second mating ends of the lower contacts extend into the host board slot for mating with the host board. The contact assembly is loaded into the cavity such that the upper blocking surfaces block the upper contacts in the upper contact channels and such that the lower blocking surfaces block the lower contacts in the lower contact channels.

DETAILED DESCRIPTION OF THE INVENTION

Figure 1:
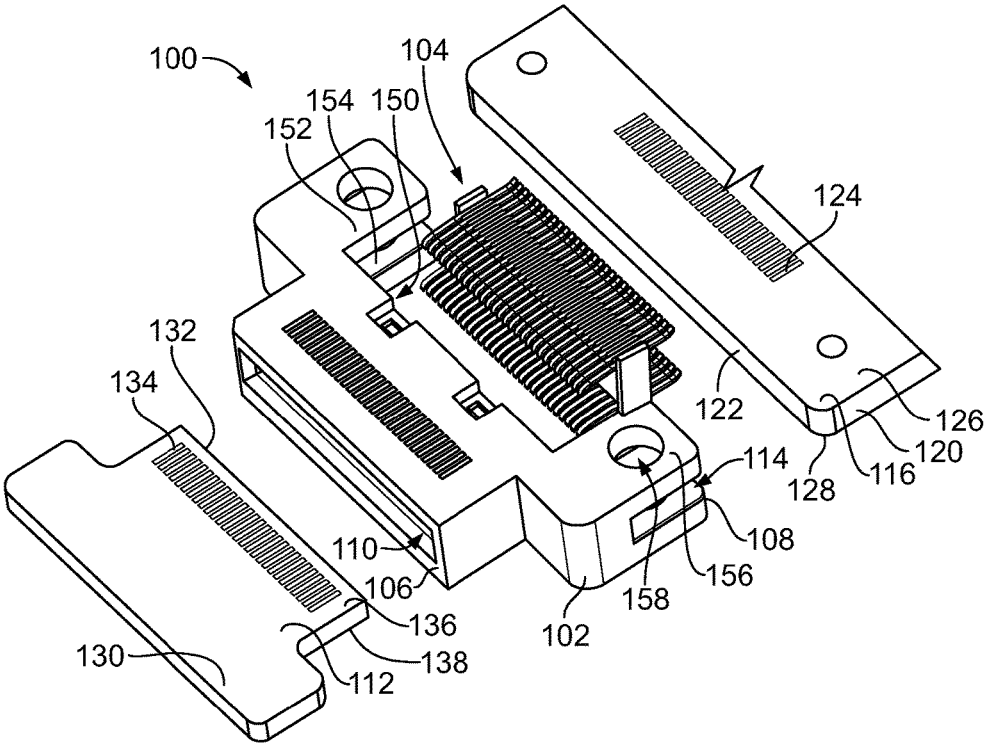
FIG. 1 is a perspective view of a straddle mount connector in accordance with an exemplary embodiment.

FIG. 1 is a perspective view of a straddle mount connector 100 in accordance with an exemplary embodiment. The straddle mount connector 100 includes a housing 102 and a contact assembly 104 received in the housing 102. The housing 102 extends between a front 106 and a rear 108. The housing 102 has a mating card slot 110 at the front 106 configured to receive a mating card 112 and a host board slot 114 at the rear 108 configured to receive a host board 116. The housing 102 and the contact assembly 104 configured to be mounted to the host board 116. In an exemplary embodiment, the housing 102 and the contact assembly 104 are configured to straddle the host board 116 and are mechanically and electrically connected to an edge of the host board 116 to create a connectorized interface for electrically connecting the mating card 112 with the host board 116.

The host board 116 includes a substrate 120 having a mating edge 122 having a plurality of contact pads 124 at the mating edge 122. The contact pads 124 may be circuits or traces of the substrate 120. In an exemplary embodiment, the contact pads 124 are provided on a top surface 126 and a bottom surface 128 of the substrate 120. The housing 102 is configured to be mounted to the substrate 120 at the mating edge 122. The contact assembly 104 is configured to be electrically connected to the contact pads 124 at the mating edge 122. For example, contacts of the contact assembly 104 may be soldered to the contact pads 124.

The mating card 112 includes a substrate 130 having a mating edge 132 having a plurality of contact pads 134 at the mating edge 132. The contact pads 134 may be circuits or traces of the substrate 130. In an exemplary embodiment, the contact pads 134 are provided on a top surface 136 and a bottom surface 138 of the substrate 130. The mating edge 132 is configured to be plugged into the mating card slot 110. In an exemplary embodiment, the mating card slot 110 defines a separable mating interface with the mating card 112 where the mating card 112 may be repeatably plugged into and unplugged from the mating card slot 110 to mate and un-mate with the contacts of the contact assembly 104.

In an exemplary embodiment, the housing 102 has a cavity 150 between the mating card slot 110 and the host board slot 114 that receives the contact assembly 104. The cavity 150 is defined by an upper wall 152 and a lower wall 154. The cavity 150 may be open at the rear 108 to receive the contact assembly 104 from the rear 108. In an exemplary embodiment, the housing 102 includes mounting features 156 for mounting the housing 102 to the host board 116. In the illustrated embodiment, the mounting features 156 include openings 158 for receiving fasteners to secure the housing 102 to the host board 116. Other types of mounting features may be provided in alternative embodiments. The mounting features 156 may be used to permanently secure the housing 102 to the host board 116.

Figure 2:
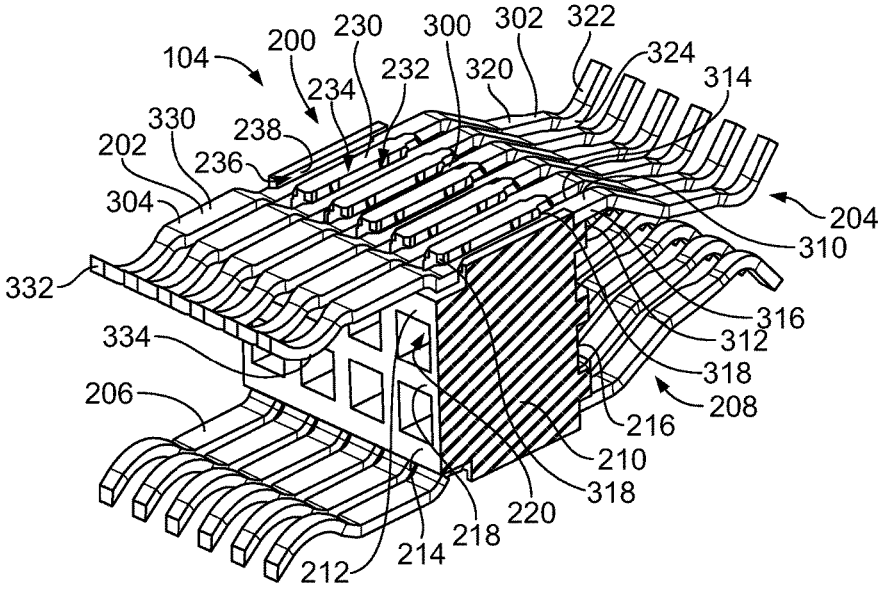
FIG. 2 is a top, rear perspective, partial sectional view of a portion of a contact assembly of the straddle mount connector in accordance with an exemplary embodiment.
Figure 3:
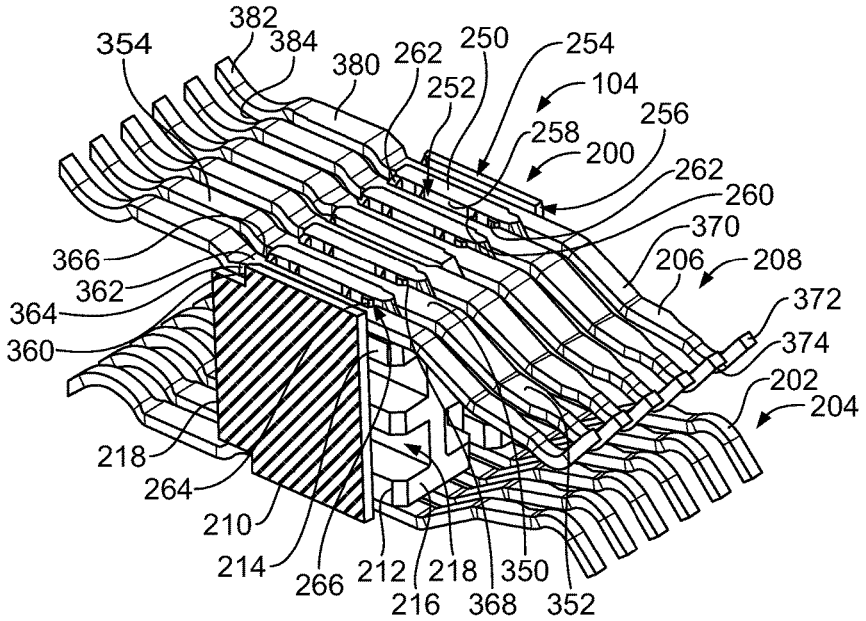
FIG. 3 is a bottom, front perspective, partial sectional view of a portion of the contact assembly in accordance with an exemplary embodiment.
Figure 4:
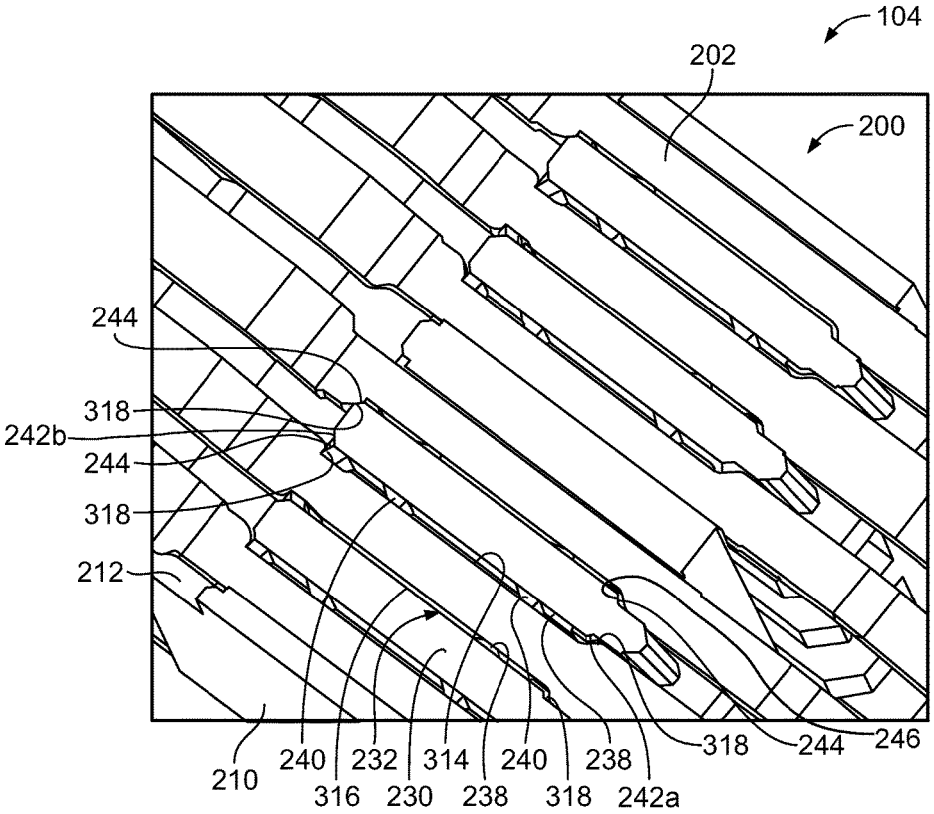
FIG. 4 is a top view of a portion of the contact assembly in accordance with an exemplary embodiment.

FIG. 2 is a rear perspective, partial sectional view of a portion of the contact assembly 104 in accordance with an exemplary embodiment. FIG. 3 is a front perspective, partial sectional view of a portion of the contact assembly 104 in accordance with an exemplary embodiment. FIG. 4 is a top view of a portion of the contact assembly 104 in accordance with an exemplary embodiment. The contact assembly 104 includes a contact organizer 200 holding upper contacts 202 in an upper contact array 204 and holding lower contacts 206 and a lower contact array 208. Any number of upper and lower contacts 202, 206 may be provided in the arrays 204, 208 depending on the particular application and corresponding to the number of contact pads 124, 134 on the host board 116 and the mating card 112, respectively. The upper and lower contacts 202, 206 may be quickly and easily assembled with the contact organizer 200 by simply loading the upper and lower contacts 202, 206 into the pre-molded contact organizer 200 from above and below, and then the contact organizer 200 may be loaded into the housing 102.

The contact organizer 200 includes a unitary body 210 having a top wall 212 and a bottom wall 214. The upper contacts 202 are held along the top wall 212 and the lower contacts 206 are held along the bottom wall 214. The contact organizer 200 extends between a front 216 and a rear 218. In an exemplary embodiment, the body 210 includes impedance cores 220 extending therethrough between the front 216 and the rear 218 for impedance control between the upper and lower contacts 202, 206. The impedance cores 220 introduce air between the upper and lower contacts 202, 206. The size and shapes of the impedance cores 220 may be adjusted to control the impedance of the signals transmitted by the upper and lower contacts 202, 206. The proximity of the impedance cores 220 to the upper and lower contacts 202, 206 may be adjusted to control the impedance of the signals transmitted by the upper and lower contacts 202, 206.

In an exemplary embodiment, the contact organizer 200 includes upper rails 230 extending from the top wall 212 forming upper contact channels 232 therebetween. The upper contact channels 232 are open at tops 234 thereof forming windows 236 between the upper rails 230 above the upper contacts 202. The windows 236 are formed by the spaces or voids between the upper rails 230 above the upper contacts 202. The windows 236 expose the upper contacts 202 in the upper contact channels 232 between the upper rails 230. The upper rails 230 have sides 238 facing the upper contact channels 232. The sides 238 face the upper contacts 202. The sides 238 may engage the upper contacts 202 to hold the upper contacts 202 in the upper contact channels 232. In an exemplary embodiment, the upper rails 230 include protrusions 240 extending from the sides 238 into the upper contact channels 232. The protrusions 240 engage the upper contacts 202 to hold the upper contacts 202 in the upper contact channels 232. The protrusions 240 may hold the upper contacts 202 by an interference fit. Optionally, the protrusions 240 may have ledges that capture the upper contacts 202 in the upper contact channels 232, such as below the ledges (for example, between the ledges and the tops 234.

In an exemplary embodiment, the contact organizer 200 includes upper locating features 242 that engage the upper contacts 202 to locate the upper contacts 202 relative to the body 210. In an exemplary embodiment, the upper locating features 242 axially position the upper contacts 202 relative to the body 210. In various embodiments, the upper locating features 242 are formed along the upper rails 230. For example, the upper locating features 242 may be locating shoulders 244 defined by undercuts 246 formed in the upper rails 230. For example, the undercut 246 (FIG. 4) may be provided at the fronts and/or the rear of the upper rails 230 to form the locating shoulders 244. The locating shoulders 244 provide surfaces used to axially position the upper contacts 202 within the upper contact channels 232. For example, the upper contacts 202 may have complementary shapes configured to engage the locating shoulders 244 to resist forward and/or rearward axial movement within the upper contact channel 232. In an exemplary embodiment, the upper locating features 242 include both forward facing upper locating features 242*a* and a rearward facing upper locating features 242*b* to axially resist forward and rearward movement of the upper contacts 202 relative to the body 210. As such, the upper contacts 202 may be axially fixed against both forward and rearward movement by the upper locating features 242.

In an exemplary embodiment, the contact organizer 200 includes lower rails 250 extending from the bottom wall 214 forming lower contact channels 252 therebetween. The lower contact channels 252 are open at bottoms 254 thereof forming windows 256 between the lower rails 250 below the lower contacts 206. The windows 256 are formed by the spaces or voids between the lower rails 250 above the lower contacts 206. The windows 256 expose the lower contacts 206 in the lower contact channels 252 between the lower rails 250. The lower rails 250 have sides 258 facing the lower contact channels 252. The sides 258 face the lower contacts 206. The sides 258 may engage the lower contacts 206 to hold the lower contacts 206 in the lower contact channels 252. In an exemplary embodiment, the lower rails 250 include protrusions 260 extending from the sides 258 into the lower contact channels 252. The protrusions 260 engage the lower contacts 206 to hold the lower contacts 206 in the lower contact channels 252. The protrusions 260 may hold the lower contacts 206 by an interference fit. Optionally, the protrusions 260 may have ledges that capture the lower contacts 206 in the lower contact channels 252 below the ledges (for example, between the ledges and the bottoms 254.

In an exemplary embodiment, the contact organizer 200 includes lower locating features 262 that engage the lower contacts 206 to locate the lower contacts 206 relative to the body 210. In an exemplary embodiment, the lower locating features 262 axially position the lower contacts 206 relative to the body 210. In various embodiments, the lower locating features 262 are formed along the lower rails 250. For example, the lower locating features 262 may be formed by locating shoulders 264 defined by undercuts 266 (FIG. 3) formed in the lower rails 250. For example, the undercut 266 may be provided at the fronts and/or the rear of the lower rails 250 to form the locating shoulders 264. The locating shoulders 264 provide surfaces used to axially position the lower contacts 206 within the lower contact channels 252. For example, the lower contacts 206 may have complementary shapes configured to engage the locating shoulders 264 to resist forward and/or rearward axial movement within the lower contact channel 252. In an exemplary embodiment, the locating features 262 are provided to axially resist forward and rearward movement of the lower contacts 206 relative to the body 210.

Each upper contact 202 includes a main body 300, a first mating end 302 extending from the main body 300 and a second mating end 304 extending from the main body 300. The main body 300 is configured to be captured in the corresponding upper contact channel 232 of the contact organizer 200. The first mating end 302 extends forward of the body 210 and the second mating end 304 extends rearward of the body 210. The first mating end 302 is configured to extend into the mating card slot 110 for mating with the mating card 112 and the second mating end 304 is configured to extend into the host board slot 114 for mating with the host board 116.

The main body 300 includes a top side 310, a bottom side 312, a first edge 314 and a second edge 316. The bottom side 312 rests on the top wall 212. The top side 310 faces the open window 236. The edges 314, 316 face the sides 238 of the corresponding upper rails 230. Optionally, the first edge 314 and/or the second edge 316 may include a locating feature 318 configured to engage the corresponding upper locating feature 242 to locate the upper contact 202 within the upper contact channel 232. For example, the locating feature 318 may include a shoulder, a tab, a notch, or another feature configured to interact with the upper locating feature 242 to hold an axial position of the upper contact 202 within the upper contact channel 232.

The first mating end 302 includes a mating arm 320 having a mating finger 322 at a distal end of the mating arm 320. The mating finger 322 includes a mating interface 324 configured to engage the mating card 112. In the illustrated embodiment, the mating finger 322 is curved to define an interface bump for mating with the contact pad 134 of the mating card 112. The mating finger 322 may extend beyond the mating interface 324 to provide guidance for the mating card 112 during mating and to prevent stubbing with the mating card 112 during mating. In an exemplary embodiment, the mating arm 320 defines a deflectable spring finger configured to be deflected outward during mating with the mating card 112.

The second mating end 304 includes a mating arm 330 having a mating finger 332 at a distal end of the mating arm 330. The mating finger 332 includes a mating interface 334 configured to engage the host board 116. In the illustrated embodiment, the mating finger 332 is curved to define an interface bump for mating with the contact pad 124 of the host board 116. The mating finger 332 may extend beyond the mating interface 334 to provide guidance for the host board 116 mating and to prevent stubbing with the host board 116 during mating. In an exemplary embodiment, the mating arm 330 defines a deflectable spring finger configured to be deflected outward during mating with the host board 116. Optionally, the mating finger 322 may be soldered to the contact pad 124 of the host board 116.

Each lower contact 206 includes a main body 350, a first mating end 352 extending from the main body 350 and a second mating end 354 extending from the main body 350. The main body 350 is configured to be captured in the corresponding lower contact channel 252 of the contact organizer 200. The first mating end 352 extends forward of the body 210 and the second mating end 354 extends rearward of the body 210. The first mating end 352 is configured to extend into the mating card slot 110 for mating with the mating card 112 and the second mating end 354 is configured to extend into the host board slot 114 for mating with the host board 116.

The main body 350 includes a top side 360, a bottom side 362, a first edge 364 and a second edge 366. The top side 360 abuts against the bottom wall 214. The bottom side 362 faces the open window 256. The edges 364, 366 face the sides 258 of the corresponding lower rails 250. Optionally, the first edge 364 and/or the second edge 366 may include a locating feature 368 configured to engage the corresponding lower locating feature 262 to locate the lower contact 206 within the lower contact channel 252. For example, the locating feature 368 may include a shoulder, a tab, a notch, or another feature configured to interact with the lower locating feature 262 to hold an axial position of the lower contact 206 within the lower contact channel 252.

The first mating end 352 includes a mating arm 370 having a mating finger 372 at a distal end of the mating arm 370. The mating finger 372 includes a mating interface 374 configured to engage the mating card 112. In the illustrated embodiment, the mating finger 372 is curved to define an interface bump for mating with the contact pad 134 of the mating card 112. The mating finger 372 may extend beyond the mating interface 374 to provide guidance for the mating card 112 during mating and to prevent stubbing with the mating card 112 during mating. In an exemplary embodiment, the mating arm 370 defines a deflectable spring finger configured to be deflected outward during mating with the mating card 112.

The second mating end 354 includes a mating arm 380 having a mating finger 382 at a distal end of the mating arm 380. The mating finger 382 includes a mating interface 384 configured to engage the host board 116. In the illustrated embodiment, the mating finger 382 is curved to define an interface bump for mating with the contact pad 124 of the host board 116. The mating finger 382 may extend beyond the mating interface 384 to provide guidance for the host board 116 mating and to prevent stubbing with the host board 116 during mating. In an exemplary embodiment, the mating arm 380 defines a deflectable spring finger configured to be deflected outward during mating with the host board 116. Optionally, the mating finger 372 may be soldered to the contact pad 124 of the host board 116.

As previously mentioned, FIG. 4 shows the upper contacts 202 in the upper contact channels 232. The upper contacts 202 are supported by the top wall 212 between the upper rails 230. The protrusions 240 extend from the sides 238 to position the upper contacts 202 in the upper contact channels 232. The upper locating features 242 locate the upper contacts 202 within the upper contact channels 232. For example, the locating shoulders 244 engage the locating features 318 of the upper contacts 202 to axially position the upper contacts 202 within the upper contact channels 232. In the illustrated embodiment, the contact organizer 200 includes both forward facing upper locating features 242 and rearward facing upper locating features 242 to axially recessed forward and rearward movement of the upper contacts 202 relative to the body 210. The locating features 318 may be provided along the first edge 314 and/or the second edge 316 of the upper contacts 202.

Figure 5:
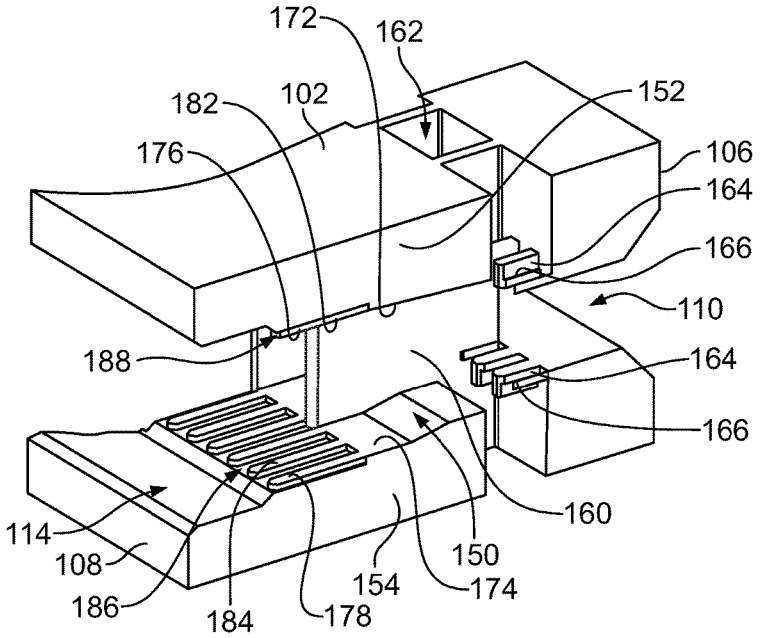
FIG. 5 is a rear perspective, partial sectional view of a housing of the straddle mount connector in accordance with an exemplary embodiment.
Figure 6:
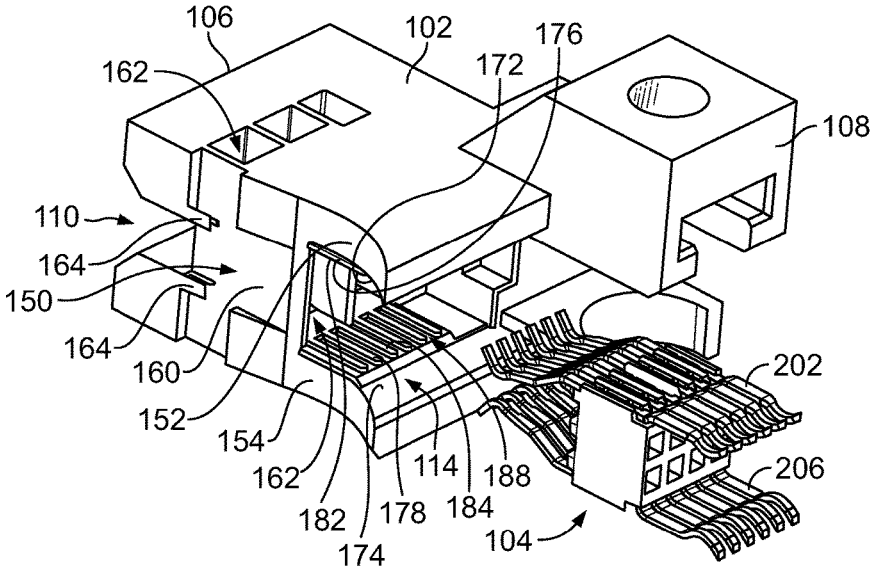
FIG. 6 is a rear perspective, partial sectional view of the housing in accordance with an exemplary embodiment showing the contact assembly poised for loading into the housing.

FIG. 5 is a rear perspective, partial sectional view of the housing 102 in accordance with an exemplary embodiment. FIG. 6 is a rear perspective, partial sectional view of the housing 102 in accordance with an exemplary embodiment showing the contact assembly 104 poised for loading into the housing 102. The housing 102 includes the cavity 150 defined by the upper wall 152 and the lower wall 154. The cavity 150 extends between the mating card slot 110 at the front 106 and the host board slot 114 at the rear 108. The contact assembly 104 is configured to be loaded into the cavity 150 through the rear 108.

In an exemplary embodiment, the housing 102 includes separating walls 160 between the upper wall 152 and the lower wall 154. The separating walls 160 may extend vertically within the cavity 150 at least partially between the front 106 and the rear 108. Optionally, the separating walls 160 may define bottoms of the mating card slot 110 and the host board slot 114 against which the mating card 112 and the host board 116 may abut against when loaded into the corresponding mating card slot 110 and the host board slot 114.

In an exemplary embodiment, the housing 102 includes impedance cores 162 extending through the upper wall 152 and/or the lower wall 154 for impedance control between the upper and lower contacts 202, 206 when the contact assembly 104 is received in the cavity 150. The impedance cores 162 introduce air between the upper and lower contacts 202, 206. The size and shapes of the impedance cores 162 may be adjusted to control the impedance of the signals transmitted by the upper and lower contacts 202, 206. The proximity of the impedance cores 162 to the upper and lower contacts 202, 206 may be adjusted to control the impedance of the signals transmitted by the upper and lower contacts 202, 206. The impedance cores 162 may be defined, at least in part, by the separating walls 160.

In an exemplary embodiment, the housing 102 includes contact locators 164 at the mating card slot 110 for locating the upper and lower contacts 202, 206 within the mating card slot 110. The upper and lower contacts 202, 206 are configured to engage the contact locators 164 at the mating card slot 110 for positioning the upper and lower contacts 202, 206 for mating with the mating card 112. In the illustrated embodiment, the contact locators 164 include ledges 166 configured to engage and support the contacts 202, 206 to position the contacts 202, 206 within the mating card slot 110.

The upper wall 152 includes an upper surface 172 configured to support the upper contacts 202 within the cavity 150. The upper surface 172 may be shaped to receive the upper contacts 202. For example, the upper surface 172 may include a series of steps, ramps, ridges, or other features that accommodate the shape of the upper contacts 202. The lower wall 154 includes a lower surface 174 configured to support the lower contacts 206 within the cavity 150. The lower surface 174 may be shaped to receive the lower contacts 206. For example, the lower surface 174 may include a series of steps, ramps, ridges, or other features that accommodate the shape of the lower contacts 206.

In an exemplary embodiment, the housing 102 includes upper ribs 176 extending from the upper wall 152 and the housing includes lower ribs 178 extending from the lower wall 154. The upper ribs 176 define upper blocking surfaces 182 and the lower ribs 178 defined lower blocking surfaces 184. The blocking surfaces 182, 184 are used to block and hold the contacts 202, 206 in the contact assembly 104 when the contact assembly 104 is loaded in the cavity 150, as described in further detail below. Upper pockets 186 are defined between the upper ribs 176 and lower pockets 188 are defined between the lower ribs 178. The pockets 186, 188 are open at the rears thereof.

In an exemplary embodiment, the housing 102 is manufactured from a dielectric material, such as a plastic material. The housing 102 may be manufactured by injection molding in various embodiments. In an exemplary embodiment, the cores and cavities may all be formed from a tooling die pulled from the rear 108 of the housing 102 making design and manufacture of the housing 102 simple and cost-effective.

Figure 7:
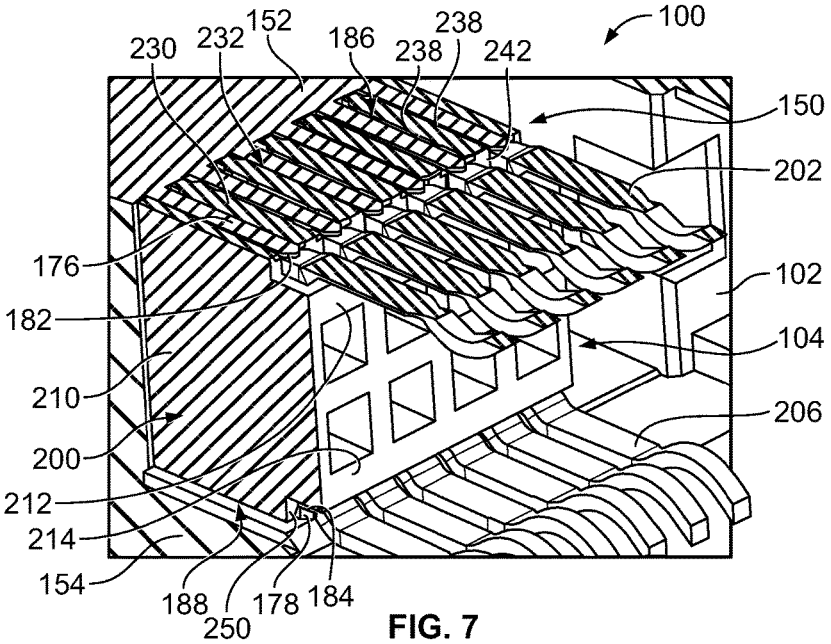
FIG. 7 is a rear perspective partial sectional view of the straddle mount connector showing the contact assembly loaded in the housing in accordance with an exemplary embodiment.
Figure 8:
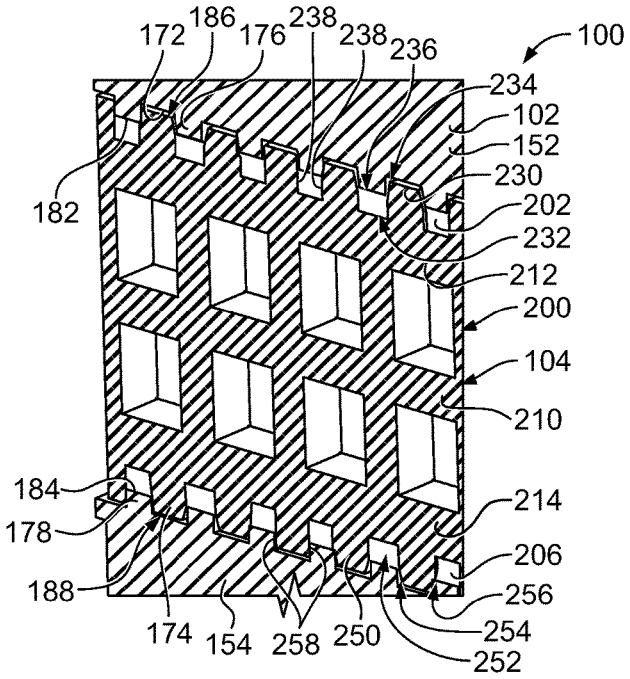
FIG. 8 is a rear perspective, partial sectional view of the straddle mount connector showing the contact assembly loaded in the housing in accordance with an exemplary embodiment.

FIG. 7 and FIG. 8 each depict rear perspective partial sectional views of the straddle mount connector 100 showing the contact assembly 104 loaded in the housing 102 in accordance with an exemplary embodiment. The contact assembly 104 is loaded into the cavity 150 such that the upper blocking surfaces 182 of the housing 10 to block the upper contacts 202 in the upper contact channels 232 and such that the lower blocking surfaces 184 block the lower contacts 206 in the lower contact channels 252. In an exemplary embodiment, when the contact assembly 104 is loaded in the housing 102, the upper ribs 176 are received in corresponding upper contact channels 232 between the upper rails 230 engage the upper contacts 202. Similarly, the lower ribs 178 are received in corresponding lower contact channels 252 between the lower rails 250 to engage the lower contacts 206. For example, the upper and lower contact channels 232, 252 are deep enough to receive the upper and lower ribs 176, 178 above and below the contacts 202, 206, respectively. The distal ends of the upper rails 230 and the lower rails 250 are received in the upper pockets 186 and the lower pockets 188, respectively between the upper ribs 176 and the lower ribs 178, respectively.

The windows 236 are defined between the sides 238 of the upper rails 230 above the upper contacts 202 to receive the upper ribs 176. When the upper ribs 176 are received through the open tops 234 of the upper contact channels 232, the upper blocking surfaces 182 engage the upper contacts 202. As such, the upper contacts 202 are vertically positioned and sandwiched between the top wall 212 and the corresponding upper blocking surface 182. Additionally, the upper contacts 202 are axially positioned by the upper locating features 242. As such, the upper contacts 202 are reliably captured between the body 210 of the contact organizer 200 and the housing 102 for mechanical and electrical connection with the mating card 112 and the host board 116.

The windows 256 are defined between the sides 258 of the lower rails 250 below the lower contacts 206 to receive the lower ribs 178. When the lower ribs 178 are received through the open bottoms 254 of the lower contact channels 252, the lower blocking surfaces 184 engage the lower contacts 206. As such, the lower contacts 206 are vertically positioned and sandwiched between the bottom wall 214 and the corresponding lower blocking surface 184. Additionally, the lower contacts 206 are axially positioned by the lower locating features 262. As such, the lower contacts 206 are reliably captured between the body 210 of the contact organizer 200 and the housing 102 for mechanical and electrical connection with the mating card 112 and the host board 116.

In alternative embodiments, rather than having the upper and lower ribs 176, 178 extending into the upper and lower contact channels 232, 252, the upper and lower rails 230, 250 may have a height equal to a height of the upper and lower contacts 202, 206 such that the upper and lower surfaces 172, 174 of the upper and lower walls 152, 154 of the housing 102 block the upper and lower contacts 202, 206 in the upper and lower contact channels 232, 252. In such embodiment, the upper and lower surfaces 172, 174 of the walls 152, 154 define the upper and lower blocking surfaces 182, 184 without having upper and lower ribs 176, 178 extending therefrom.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A straddle mount connector comprising:

a housing extending between a front and a rear, the housing having a mating card slot at the front configured to receive a mating card, the housing having a host board slot at the rear configured to receive a host board, the housing having a cavity between the mating card slot and the host board slot defined by an upper wall and a lower wall, the upper wall having upper blocking surfaces, the lower wall having lower blocking surfaces; and a contact assembly received in the cavity of the housing, the contact assembly having a contact organizer including a unitary body having a top wall and a bottom wall, the contact organizer having upper contact channels in the top wall and lower contact channels in the bottom wall, the upper contact channels having upper locating features, the lower contact channels having lower locating features, the contact assembly having upper contacts arranged in an upper contact array and lower contacts arranged in a lower contact array, the upper contacts received in corresponding upper contact channels and engaging corresponding upper locating features, the lower contacts received in corresponding lower contact channels and engaging corresponding lower locating features, the upper contacts and the lower contacts configured to be electrically connected to the host board and the mating card;

wherein the contact assembly is loaded into the cavity such that the upper blocking surfaces block the upper contacts in the upper contact channels and such that the lower blocking surfaces block the lower contacts in the lower contact channels.

2. The straddle mount connector of claim 1, wherein the upper contacts are loaded in the upper contact channels from above the body and the lower contacts are loaded in the lower contact channels from below the body.

3. The straddle mount connector of claim 1, wherein the upper contact channels are open at a top thereof for receiving the upper contacts and the lower contact channels are open at a bottom thereof for receiving the lower contacts.

4. The straddle mount connector of claim 1, wherein the upper contacts are axially positioned by the upper locating features and the upper contacts are vertically positioned and sandwiched between the top wall and the corresponding upper blocking surfaces, and wherein the lower contacts are axially positioned by the lower locating features and the lower contacts are vertically positioned and sandwiched between the bottom wall and the corresponding lower blocking surfaces.

5. The straddle mount connector of claim 1, wherein the top wall includes upper rails between corresponding upper contact channels, the upper rails defining the upper locating features, the upper rails engaging corresponding upper contacts to hold the upper contacts in the upper contact channels, and wherein the bottom wall includes lower rails between corresponding lower contact channels, the lower rails defining the lower locating features, the lower rails engaging corresponding lower contacts to hold the lower contacts in the lower contact channels.

6. The straddle mount connector of claim 5, wherein the housing includes upper ribs extending from the upper wall defining the upper blocking surfaces, the upper ribs being received in the upper contact channels between the upper rails to engage the upper contacts, and wherein the housing includes lower ribs extending from the lower wall defining the lower blocking surfaces, the lower ribs being received in the lower contact channels between the lower rails to engage the lower contacts.

7. The straddle mount connector of claim 5, wherein the contact organizer includes windows in the upper contact channels located above the upper contacts between the corresponding upper rails, the windows receiving the corresponding upper blocking surfaces of the housing, and wherein the contact organizer includes windows in the lower contact channels located below the corresponding lower contacts between the lower rails, the windows receiving the corresponding lower blocking surfaces of the housing.

8. The straddle mount connector of claim 5, wherein the upper rails include protrusions extending into the upper contact channels to engage the upper contacts and the lower rails include protrusions extending into the lower contact channels to engage the lower contacts.

9. The straddle mount connector of claim 5, wherein the upper ribs include undercuts defined by locating shoulders forming the upper locating features and the lower rails include undercuts defined by locating shoulders forming the lower locating features.

10. The straddle mount connector of claim 1, wherein the upper locating features include forward facing upper locating features and rearward facing upper locating features to axially resist forward and rearward movement of the upper contacts relative to the body, respectively, and wherein the lower locating features include forward facing lower locating features and rearward facing lower locating features to axially resist forward and rearward movement of the lower contacts relative to the body, respectively.

11. The straddle mount connector of claim 1, wherein the body includes impedance cores between the top wall and the bottom wall for impedance control between the upper contacts and the lower contacts.

12. The straddle mount connector of claim 1, wherein the housing includes impedance cores in the upper wall and in the lower wall for impedance control of the upper contacts and the lower contacts, respectively.

13. The straddle mount connector of claim 1, wherein the housing includes contact locators at the mating card slot, the upper contacts and the lower contacts engaging corresponding contact locators at the mating card slot for positioning the upper contacts and the lower contacts for mating with the mating card.

14. The straddle mount connector of claim 1, wherein each upper contact includes a first mating end extending forward of the body and a second mating end extending rearward of the body and each lower contact includes a first mating end extending forward of the body and a second mating end extending rearward of the body, wherein the contact assembly is loaded into the cavity such that the first mating ends of the upper contacts and the first mating ends of the lower contacts extend into the mating card slot for mating with the mating card and such that the second mating ends of the upper contacts and the second mating ends of the lower contacts extend into the host board slot for mating with the host board.

15. The straddle mount connector of claim 14, wherein each upper contact includes a main body between the first mating end and the second mating end, the main body being captured in the corresponding upper contact channel of the contact organizer, and wherein each lower contact includes a main body between the first mating end and the second mating end, the main body being captured in the corresponding lower contact channel of the contact organizer.

16. The straddle mount connector of claim 15, wherein the main body of the upper contact includes a top side, a bottom side, and a locating feature, the top side engaging the corresponding upper blocking surface of the housing to resist vertical upward movement, the bottom side engaging the top wall of the contact organizer to resist vertical downward movement, the locating feature engaging the upper locating feature to resist axial movement, and wherein the main body of the lower contact includes a top side, a bottom side, and a locating feature, the bottom side engaging the corresponding lower blocking surface of the housing to resist vertical downward movement, the top side engaging the bottom wall of the contact organizer to resist vertical upward movement, the locating feature engaging the lower locating feature to resist axial movement.

17. A straddle mount connector comprising:

a housing extending between a front and a rear, the housing having a mating card slot at the front configured to receive a mating card, the housing having a host board slot at the rear configured to receive a host board, the housing having a cavity between the mating card slot and the host board slot defined by an upper wall and a lower wall, the upper wall having upper ribs extending therefrom having upper blocking surfaces, the lower wall having lower ribs extending therefrom having lower blocking surfaces; and a contact assembly received in the cavity of the housing, the contact assembly having a contact organizer including a body having a top wall and a bottom wall, the contact organizer having upper contact channels in the top wall and lower contact channels in the bottom wall, the upper contact channels having upper locating features, the lower contact channels having lower locating features, the contact assembly having upper contacts arranged in an upper contact array and lower contacts arranged in a lower contact array, the upper contacts received in corresponding upper contact channels and engaging corresponding upper locating features, the lower contacts received in corresponding lower contact channels and engaging corresponding lower locating features, the upper contacts and the lower contacts configured to be electrically connected to the host board and the mating card;

wherein the contact assembly is loaded into the cavity such that the upper ribs are received in the upper contact channels with the upper blocking surfaces engaging the upper contacts and such that the lower ribs are received in the lower contact channels with the lower blocking surfaces engaging the lower contacts.

18. A straddle mount connector comprising:

a housing extending between a front and a rear, the housing having a mating card slot at the front configured to receive a mating card, the housing having a host board slot at the rear configured to receive a host board, the housing having a cavity between the mating card slot and the host board slot defined by an upper wall and a lower wall, the upper wall having upper blocking surfaces, the lower wall having lower blocking surfaces; and a contact assembly received in the cavity of the housing, the contact assembly having a contact organizer including a body having a top wall and a bottom wall, the contact organizer having upper contact channels in the top wall and lower contact channels in the bottom wall, the upper contact channels having upper locating features, the lower contact channels having lower locating features, the contact assembly having upper contacts arranged in an upper contact array and lower contacts arranged in a lower contact array, the upper contacts received in corresponding upper contact channels and engaging corresponding upper locating features, the lower contacts received in corresponding lower contact channels and engaging corresponding lower locating features, the upper contacts having first mating ends extending forward of the body and second mating ends extending rearward of the body, the lower contacts having first mating ends extending forward of the body and second mating ends extending rearward of the body;

wherein the contact assembly is loaded into the cavity such that the first mating ends of the upper contacts and the first mating ends of the lower contacts extend into the mating card slot for mating with the mating card and such that the second mating ends of the upper contacts and the second mating ends of the lower contacts extend into the host board slot for mating with the host board; and wherein the contact assembly is loaded into the cavity such that the upper blocking surfaces block the upper contacts in the upper contact channels and such that the lower blocking surfaces block the lower contacts in the lower contact channels.

19. The straddle mount connector of claim 18, wherein the upper contacts are axially positioned by the upper locating features and the upper contacts are vertically positioned and sandwiched between the top wall and the corresponding upper blocking surfaces, and wherein the lower contacts are axially positioned by the lower locating features and the lower contacts are vertically positioned in sandwiched between the bottom wall and the corresponding lower blocking surfaces.

20. The straddle mount connector of claim 18, wherein the housing includes upper ribs extending from the upper wall defining the upper blocking surfaces, the upper ribs being received in the upper contact channels to engage the upper contacts, and wherein the housing includes lower ribs extending from the lower wall defining the lower blocking surfaces, the lower ribs being received in the lower contact channels to engage the lower contacts.

* * * * *